US006409422B1

(12) United States Patent
Mittermaier et al.

(10) Patent No.: US 6,409,422 B1
(45) Date of Patent: Jun. 25, 2002

(54) PLASTIC CONCRETE FORM

(75) Inventors: Armin E. Mittermaier; Donald E. Rhodes, both of Fort Wayne, IN (US)

(73) Assignee: Poly Concrete Forms, Inc., Fort Wayne, IN (US)

( * ) Notice: Subject to any disclaimer, the term of this patent is extended or adjusted under 35 U.S.C. 154(b) by 0 days.

(21) Appl. No.: 09/141,275

(22) Filed: Aug. 27, 1998

(51) Int. Cl.[7] ..... E01F 1/00; E01F 15/00; E04G 9/00

(52) U.S. Cl. ..... 404/8; 249/2; 249/188

(58) Field of Search ..... 249/1, 2, 4, 18, 249/3, 5, 6, 7, 8, 164, 188, 210; 264/35; 52/169.7, 601; 404/7, 8; 137/356

(56) References Cited

U.S. PATENT DOCUMENTS

| | | | | | |
|---|---|---|---|---|---|
| 718,932 | A | | 1/1903 | Hundson | |
| 2,294,855 | A | * | 9/1942 | Thomason | 404/8 |
| 2,678,592 | A | * | 5/1954 | Wiedman | 404/7 |
| 2,955,018 | A | | 10/1960 | Schaschl et al. | |
| 3,124,905 | A | | 3/1964 | Stier | |
| 3,835,481 | A | | 9/1974 | Engelhart et al. | |
| 4,004,386 | A | | 1/1977 | Diffenderfer | |
| 4,048,270 | A | | 9/1977 | Stegmeier | |
| 4,055,928 | A | * | 11/1977 | Magerle | 52/612 |
| 5,015,117 | A | * | 5/1991 | Pawlicki | 249/6 |
| 5,134,819 | A | | 8/1992 | Boyack | |
| 5,275,678 | A | * | 1/1994 | West et al. | 521/40 |
| 5,700,106 | A | * | 12/1997 | Young et al. | 404/8 |
| 5,772,357 | A | * | 6/1998 | Evans | 404/7 |
| 6,010,276 | A | * | 1/2000 | Young et al. | 404/8 |
| 6,099,202 | A | * | 8/2000 | Walton et al. | 404/8 |

FOREIGN PATENT DOCUMENTS

| | | |
|---|---|---|
| CA | 616608 | 3/1961 |
| CA | 1167604 | 5/1984 |

* cited by examiner

*Primary Examiner*—Michael Safavi
(74) *Attorney, Agent, or Firm*—Randall J. Knuth

(57) ABSTRACT

An assembly for receiving poured concrete including a non-metallic form which surrounds an inner cavity and is capable of supporting poured concrete. In one particular embodiment, the assembly is composed of individual segments which are joined together to produce a rigid concrete form. The assembly is utilized as an upstanding island for location and placement of fuel dispensers.

6 Claims, 6 Drawing Sheets

PLASTIC CONCRETE FORM

BACKGROUND OF THE INVENTION

1. Field of the Invention

The present invention relates to a concrete form, and in particular, a non-metallic concrete form capable of supporting poured concrete.

2. Description of the Related Art

Concrete is used for creating concrete structures such as paved surfaces, patio slabs, sidewalks, curbs, and service station dispenser islands or bases. Liquid concrete is poured into the void or inner cavity created by the concrete forms. These forms may either be permanent or temporary. Permanent forms remain attached to the solidified concrete with the exterior surface of the permanent form creating an edge surface. Temporary forms, in contrast, are removed after the concrete solidifies to reveal a concrete edge.

Permanent-type forms have traditionally been composed of formed or stamped steel. The steel is shaped to create the desired structure's shape. The permanent-type form is typically painted to protect the form from being exposed to the environment.

Temporary forms are removed from solidified concrete to expose a concrete edge. Normally, the concrete edge is painted to seal the concrete from exposure to environment elements, such as rain, snow, salt, as well as petroleum spills, such as fuel and oil.

One problem with the current concrete forms is the lack of a non-metallic form which is capable of supporting the weight and pressure of poured concrete without the need for additional support. Traditional metallic and non-metallic forms require lateral support. The lateral support spans the form's inner cavity and provides rigidity to the concrete form. Without this support, the form would not be able to withstand or support the weight and pressure of the poured concrete. Having to provide support to the concrete form increases the cost of materials, shipping, and installing the concrete form. Together, these costs combine to increase the cost of producing a concrete structure.

Another problem with current methods of producing formed concrete, is the necessity to paint the exterior surface of a permanent-type form or the exposed concrete edge after a temporary form has been removed from the solidified concrete. It is necessary to paint and repaint the exterior surface of a permanent-type form in order to protect the form's exterior surface from exposure to the environment. Without painting or another method of sealing the form's surface, the exterior surface of a permanent-type concrete form would be subject to corrosion and wear due to rain, snow, salt, and petroleum spills. Likewise, an unpainted or unsealed concrete edge will be subject to similar wear. Long term exposure to the environment may result in deterioration of the permanent-type form or the concrete edge.

An additional problem with current methods of producing formed concrete is the cost and time required to maintain a permanent-type form's exterior surface or a concrete edge. Permanent-type concrete forms are subject to dents or scratches caused by automobiles, snowplows, and other equipment. In addition, the permanent-type form's exterior surface will show wear due to sunlight fading and petroleum spills. Similarly, the painted concrete edge will show signs of wear. As a result, the concrete edge must be repainted periodically.

Yet another problem with current concrete forms is the inability to easily shape or bend the forms to create a desired concrete structure. Current concrete forms are produced as a rigid form with a defined shape created at the manufacturer. After the concrete form is manufactured, the form's shape can not be easily modified. As a result, multiple forms of varying lengths and shapes may be required to meet one's desired concrete form needs.

SUMMARY OF THE INVENTION

According to the present invention, a non-metallic form is used as a support for poured concrete. In addition, the non-metallic form may be integrated within the poured concrete such that the exterior surface of the non-metallic form acts as a permanent edge around the poured concrete. The non-metallic form is capable of supporting the weight and pressure of poured concrete without additional lateral support.

The invention, in one form thereof, is an assembly for receiving poured concrete. The assembly includes a non-metallic form which surrounds an inner cavity. The non-metallic form is capable of supporting poured concrete. In one particular embodiment, the non-metallic form contains at least one protuberance extending into the inner cavity. In an alternate embodiment, the protuberance contains at least one syncline notch.

The invention, in another form thereof, is an assembly for receiving poured concrete to form a base on which a fuel dispenser is disposed. A non-metallic form surrounds an inner cavity. The non-metallic form is capable of containing poured concrete such that when the inner cavity is filled with poured concrete, the concrete composes a base for a fuel dispenser. In alternate embodiments, the non-metallic form is produced by extrusion molded polyethylene, injection molded polyethylene, or rotationally molded polyethylene. In another particular embodiment, an exterior cover is removably affixed to the non-metallic form.

The invention, in yet another form thereof, is a method of producing an assembly for receiving concrete. The method includes the step of providing segments of non-metallic form. The segments of non-metallic form are bent as required and fastened together. In alternate embodiments, the non-metallic form is produced by extrusion molded polyethylene, injection molded polyethylene, or rotationally molded polyethylene.

An advantage of the present invention is the strength of the non-metallic form to support poured concrete without additional support. Unlike some current concrete forms, the present invention does not typically require additional supports spanning the form's inner cavity to provide rigidity in order to sustain the pressure and weight of poured concrete.

Another advantage of a specific embodiment of the present invention is the ability of the non-metallic concrete form to self-lock into the concrete. The self-locking is achieved through at least one protuberance that extends from the concrete form into the inner cavity which is then filled with poured concrete. The advantage of self-locking concrete form to the concrete is the ability to control thermal expansion of the concrete form. The self-locking concrete form is held or maintained snug up against the edge of the concrete structure even if the concrete expands or contracts due to thermal effects.

Another advantage of the present invention is the ability to vary the overall length and shape of the concrete form. In one particular embodiment of the present invention, the non-metallic concrete form is composed of joined segments. By adding or subtracting segments, the overall length of the concrete form can be varied.

In addition, the segments of non-metallic form are flexible allowing one to shape the non-metallic form as desired. By joining varying lengths of segments and shaping the concrete form, concrete structures of varying dimensions and contours may be produced. By varying the shape and dividing the form in pieces, shipping costs may be lowered.

Yet another advantage of the present invention is the durability of the exterior surface of the non-metallic concrete form. In one particular embodiment, polyethylene provides a chemically resistant and environmentally resistant exterior surface to the concrete form. Polyethylene, unlike a painted surface, the polyethylene surface will not chip or flake away from the surface of a concrete form.

Another advantage of the present invention is the ease of maintaining the exterior surface of the non-metallic concrete form. In a particular embodiment, a removable cover, face, or rub rail attaches to the exterior surface of the non-metallic concrete form. When it is necessary to replace a damaged or worn exterior cover, the old cover is removed and a new one is installed in its place. The covers can be manufactured in any color to meet the particular needs of a user; thereby, the color of the exterior face or edge of a concrete structure may be easily changed by simply replacing one cover with a different colored cover.

An additional advantage of the present invention is the syncline notch design of one particular embodiment. A syncline notch or plurality of notches are made in the protuberance which extends into the form's inner cavity. The notch or notches permit bending, shaping, and curving of the form.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
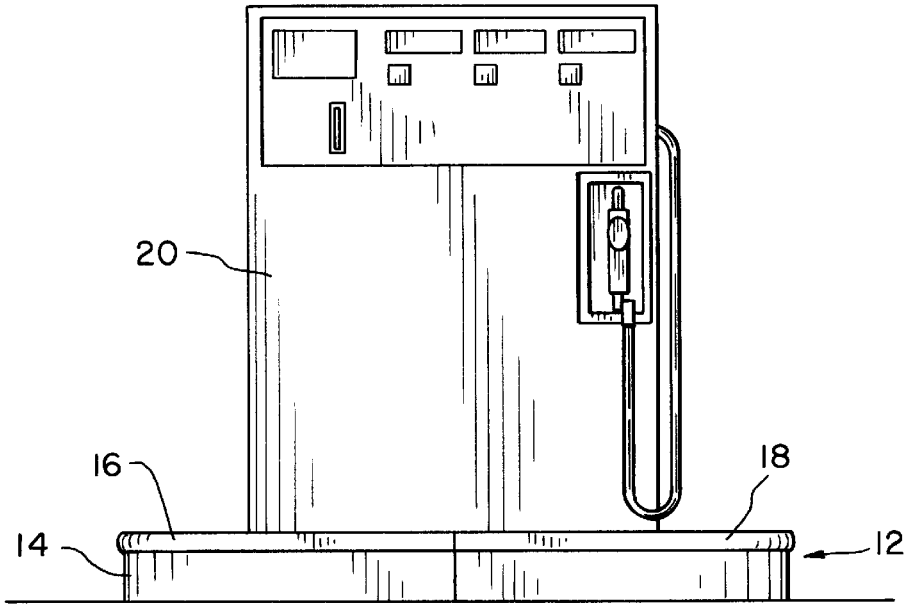
FIG. 1 is a elevational view of a fuel dispenser disposed upon a concrete base which incorporates the present invention.

Referring now to the drawings and particularly to FIG. 1, there is shown an assembly 12 for receiving poured concrete which incorporates the present invention. Assembly 12 includes non-metallic form 14 and exterior cover 16. Assembly 12, along with poured concrete (not shown) compose base 18 upon which fuel dispenser 20 is disposed.

Figure 2:
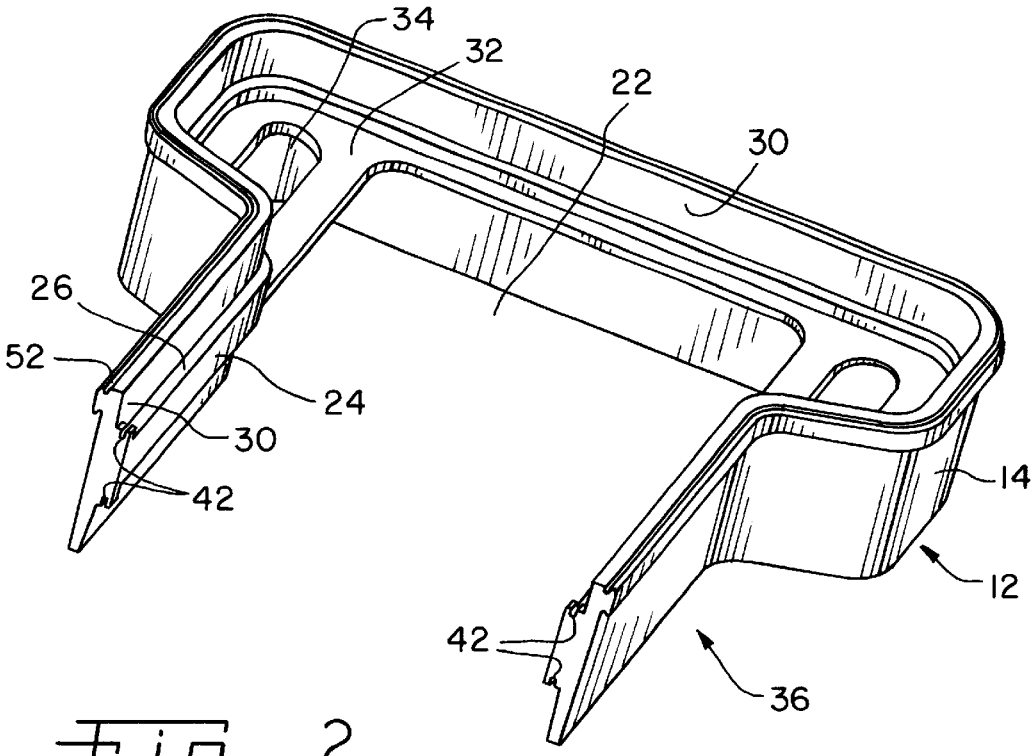
FIG. 2 is a perspective view of a non-metallic form segment.

Referring to FIG. 2, non-metallic form 14 surrounds an inner cavity 22. Protuberance 24 extends into cavity 22. Protuberance 24 contains an upward angled surface 26 and a downward angled surface 28 (best seen in FIG. 6). When cavity 22 is filled with poured concrete (FIG. 3), concrete fills around surfaces 26, 28 and abuts interior form surface 30 to lock non-metallic form 14 into the concrete. Protuberance 24 prevents non-metallic form 14 from pulling away from the poured concrete after it solidifies.

Anchor 32 is disposed within and is affixed to the corners of non-metallic form 14 and is located approximately halfway up the interior form surface 30. Anchor 32 secures non-metallic form 14 to the solidified concrete. Anchor 32 contains void 34, which is filled with poured concrete to further anchor non-metallic form 14 to the concrete. Together, anchor 32, with void 34 and protuberance 24, retards non-metallic form 14 from separating from the poured concrete after the concrete solidifies.

The locking of non-metallic form 14 to the solidified concrete maintains non-metallic form 14 snug against the concrete. When the concrete is subject to thermal expansion and contraction, non-metallic form 14 will similarly expand and contract due to the locking of form 14 to the concrete.

Figure 3:
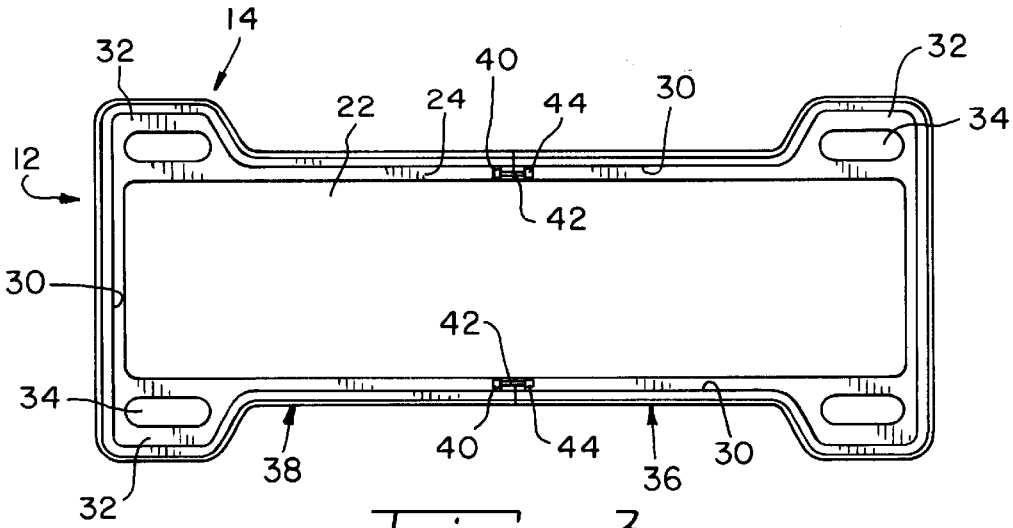
FIG. 3 is a top view of a non-metallic form.

Referring now to FIG. 3, in one particular embodiment, non-metallic form 14 is composed of two segments 36 and 38. Segments 36, 38 are fastened together by bolts 40 inserted through apertures 42 and tightened down on nuts 44. While depicted in FIG. 3, non-metallic form 14 is composed of two segments 36, 38, non-metallic form 14 may be composed of additional segments. Bolts 40 hold segments 36, 38 together and provide rigidity to non-metallic form 14 whereby inner cavity 22 may be filled with poured concrete.

After segments 36, 38 are joined together, liquid concrete is poured into inner cavity 22. Non-metallic form 14 is sufficiently rigid and strong to support the pressure and weight exerted by the poured concrete on interior surface 30 without supports spanning inner cavity 22. Once the poured concrete has solidified, the concrete composes base 18 for fuel dispenser 20 (FIG. 1).

Alternatively, non-metallic form 14 can be used as a form for other concrete structures including but not limited to patio slabs, sidewalks, curbs, and retaining walls.

Figure 6:
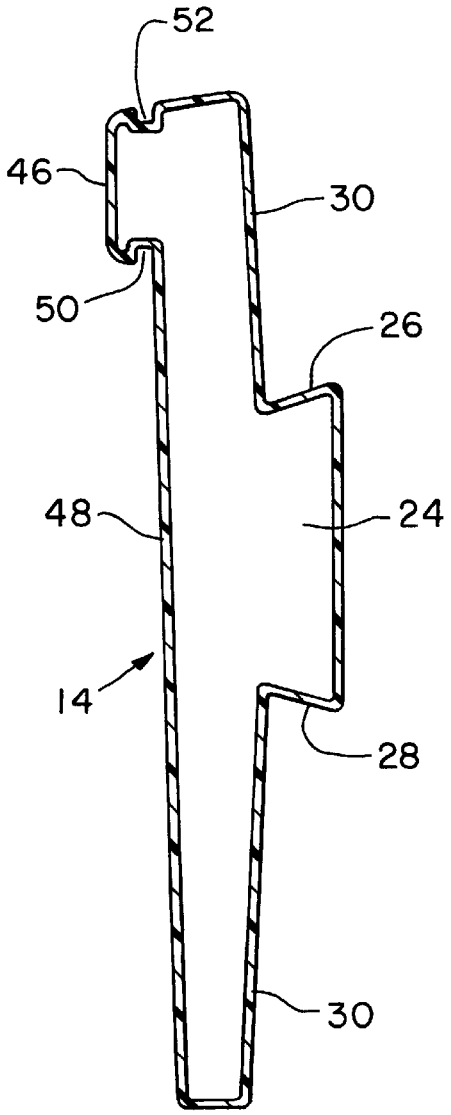
FIG. 6 is a cross-sectional view of the non-metallic form of FIG. 4.

FIG. 6 is a cross-sectional view of the non-metallic form 14. Projection 46 extends from exterior surface 48 of non-metallic form 14. Projection 46 defines a groove 50 and channel 52.

Figure 4:
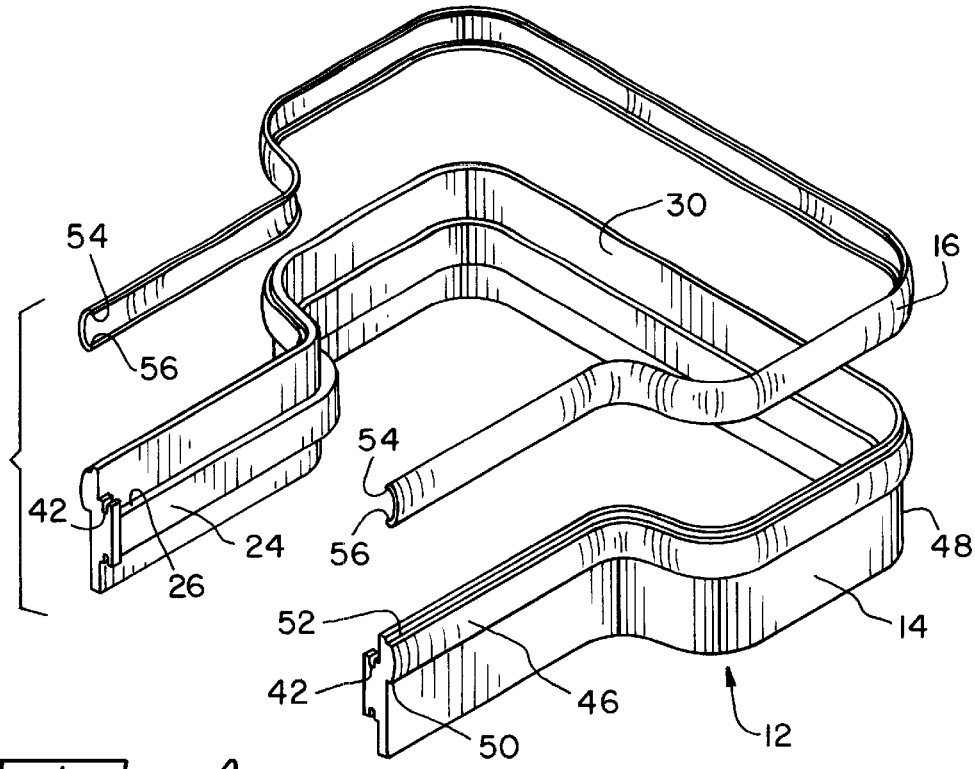
FIG. 4 is an exploded perspective view of a non-metallic form and exterior cover.

Exterior cover 16 is provided and contains upper and lower tabs 54 and 56 (FIG. 4). Tab 54 form fits into channel 52 and tab 56 form fits into groove 50. The interior surface contour of cover 16 substantially matches the contour of projection 46. Exterior cover 16 attached over projection 46 by inserting tab 54 into channel 52, followed by snapping tab 56 into groove 50. Exterior channel 16 is composed of a flexible material such that it is able to be snapped into place. Exterior cover 16 can be removed from projection 46 by pulling tab 56 away from groove 50, followed by lifting exterior cover 16 off of non-metallic form 14.

Exterior cover 16 may be any color and it may be composed of any appropriate material, such as polyethylene or rubber. In addition, exterior cover 16 serves as a replaceable rub rail and may be easily replaced if cover 16 becomes damaged or one wishes to change the color of exterior cover 16 no assembly 12.

Figure 5:
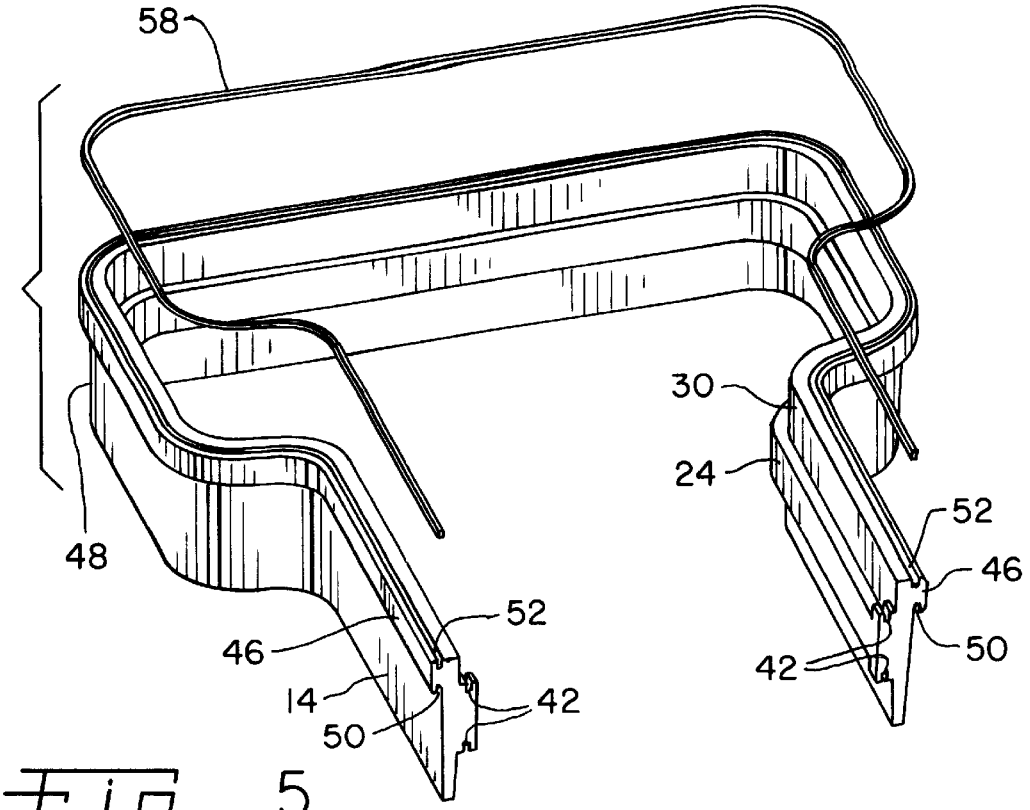
FIG. 5 is an exploded perspective view of a non-metallic form with non-metallic band.

Referring now to FIG. 5, a band 58 fits and attaches into channel 52 when exterior cover 16 is not used. Band 58 fills the void-of channel 52 and keeps debris, rain, snow, salt, ice, petroleum, etc. from collecting within channel 52. Band 58 may be composed of any appropriate material, such a polyethylene or rubber, and may be colored to correspond the color scheme of assembly 12.

Figure 7:
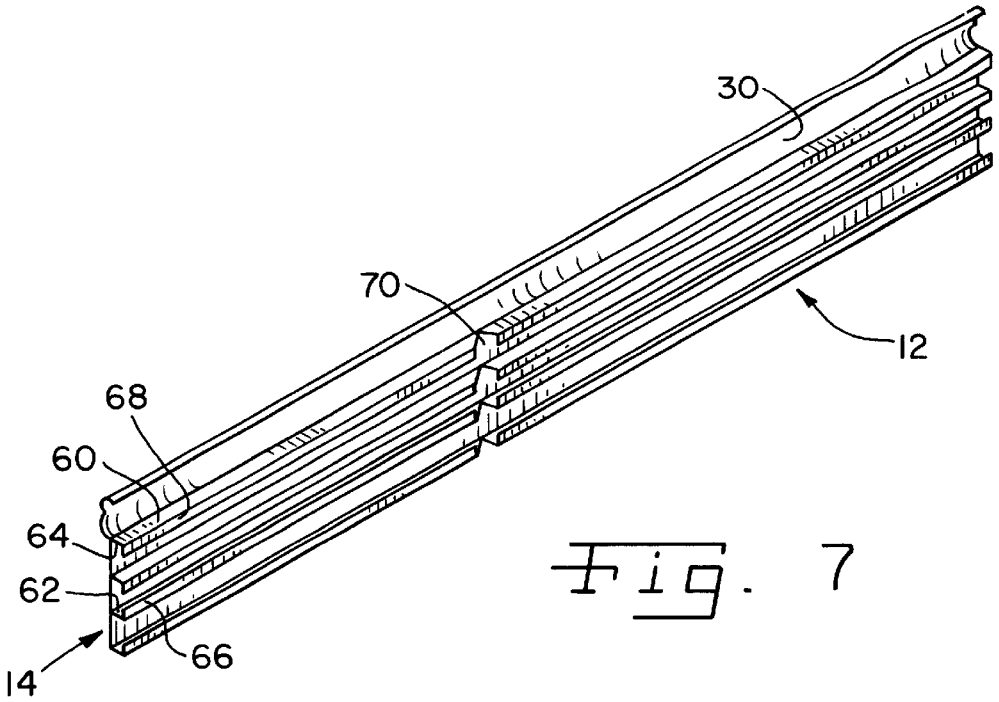
FIG. 7 is a perspective view of the present invention depicting a non-metallic form with syncline shaped notched protuberances.
Figure 8:
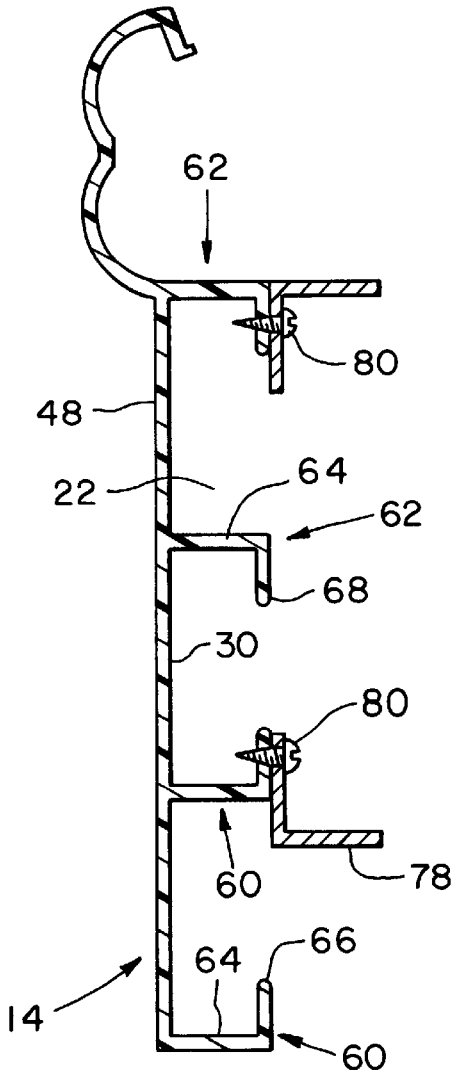
FIG. 8 is a top view of a non-metallic form fastened to a metallic structure.

Referring now to FIGS. 7 and 8, a plurality of alternately rotated upward "L"-shaped protuberances and downward "L"-shaped protuberances 60, 62, respectively, project from interior surface into inner cavity 22. Upward "L"-shaped protuberance 60 contains horizontal portion 64 which extends relatively perpendicular to inner surface 30, and vertical upward extending portion 66, which extends upward, in a direction parallel to interior surface 30. Downward "L"-shaped projection 62 contains horizontal portion 64 and vertical downward extending portion 68. As depicted in FIG. 8, non-metallic form 14 is fastened to metal structure 78 by screws 80. Metal structure 78 may be part of dispenser 20 or a part of a web or lattice framework disposed within inner cavity 22 to be filled with poured concrete.

Figure 9:
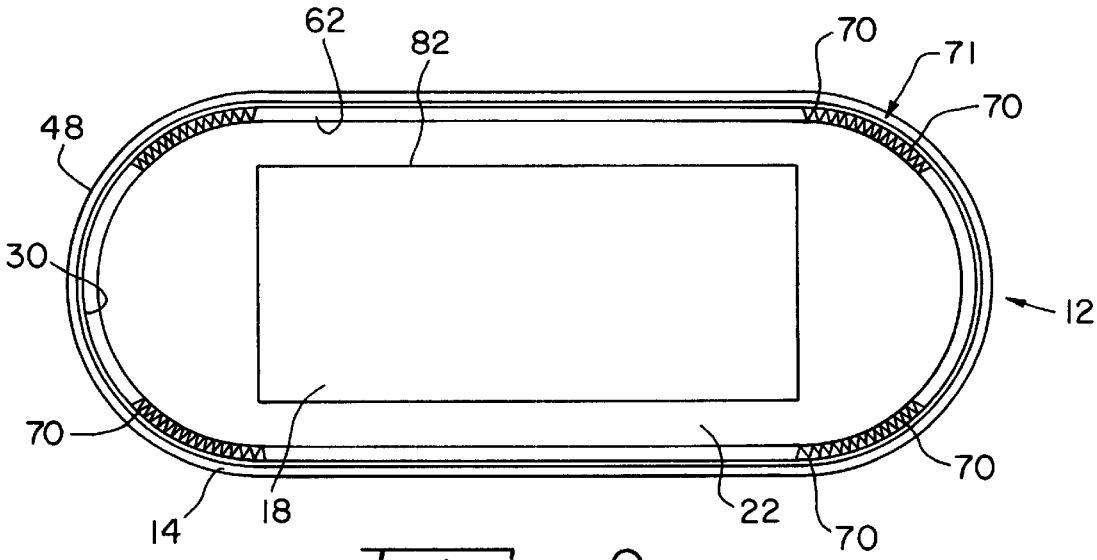
FIG. 9 is a top view of the present invention depicting a non-metallic concrete form with notched extending protuberances.

As depicted in FIG. 9, assembly 12 is composed of non-metallic form of 14 with "L-shaped" protuberances 60, 62. Concrete poured into inner cavity 22 fills in and around "L"-shaped protuberances 60, 62 and lock non-metallic form 14 to the concrete when the concrete solidifies. Protuberances 60, 62 hold non-metallic form 14 snug against concrete and allow non-metallic form 14 to conform to the concrete as the concrete expands and contracts due to thermal expansion and contraction. "L"-shaped protuberances 60, 62 contain syncline notches 70. Syncline notches 70 allows non-metallic form 14 to be bent or shaped. As shown in FIG. 9, a plurality of syncline notches compose curved portion 71 of non-metallic form 14. When the poured concrete solidifies, the resulting concrete structure is used as a base for a fuel dispenser which is depicted as outline of fuel dispenser 82.

Figure 10:
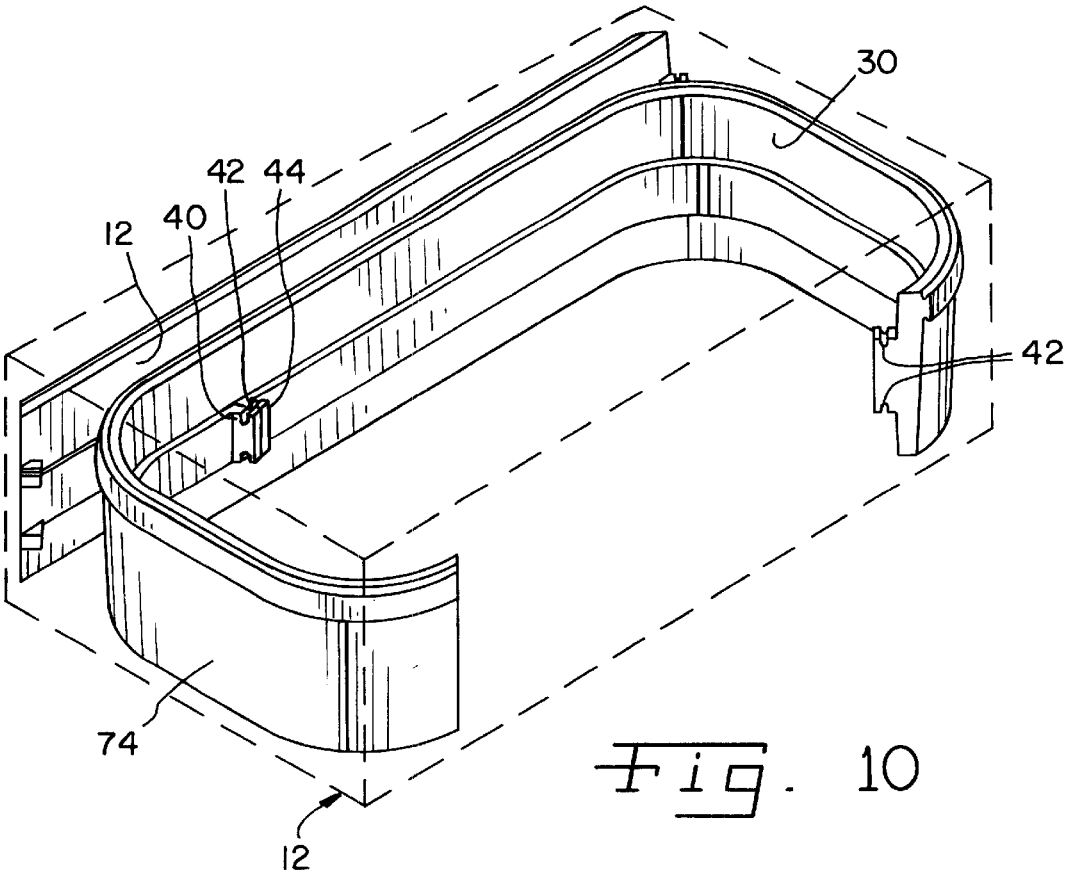
FIG. 10 depicts a perspective view of the present invention.

Referring now to the embodiment shown in FIG. 10, non-metallic form 14 is composed of four segments, two linear segments 72, and two curved segments 74. Segments 72, 74 are fastened together by bolts 40 inserted through apertures 42 and tightened down with nuts 44. The advantage of this embodiment is the ability to package the present invention in the smallest container possible for shipping and storage.

Delivery services and freight carriers have package dimension restrictions. For example, currently, a parcel shipped by United Parcel Service (UPS) must have a combined circumference plus height less than 130 inches. The United States Postal Service (USPS) currently has a dimension restriction whereby the length plus height cannot exceed 108 inches. Therefore, for shipping purposes, it may be necessary to limit the size of each individual segment such that when packaged together, the segments will fit in a container having a sum dimension of length plus height within the range of 108 inches or less, or having a container with a sum dimension of circumference plus height within the range of 130 inches or less.

Figure 11:
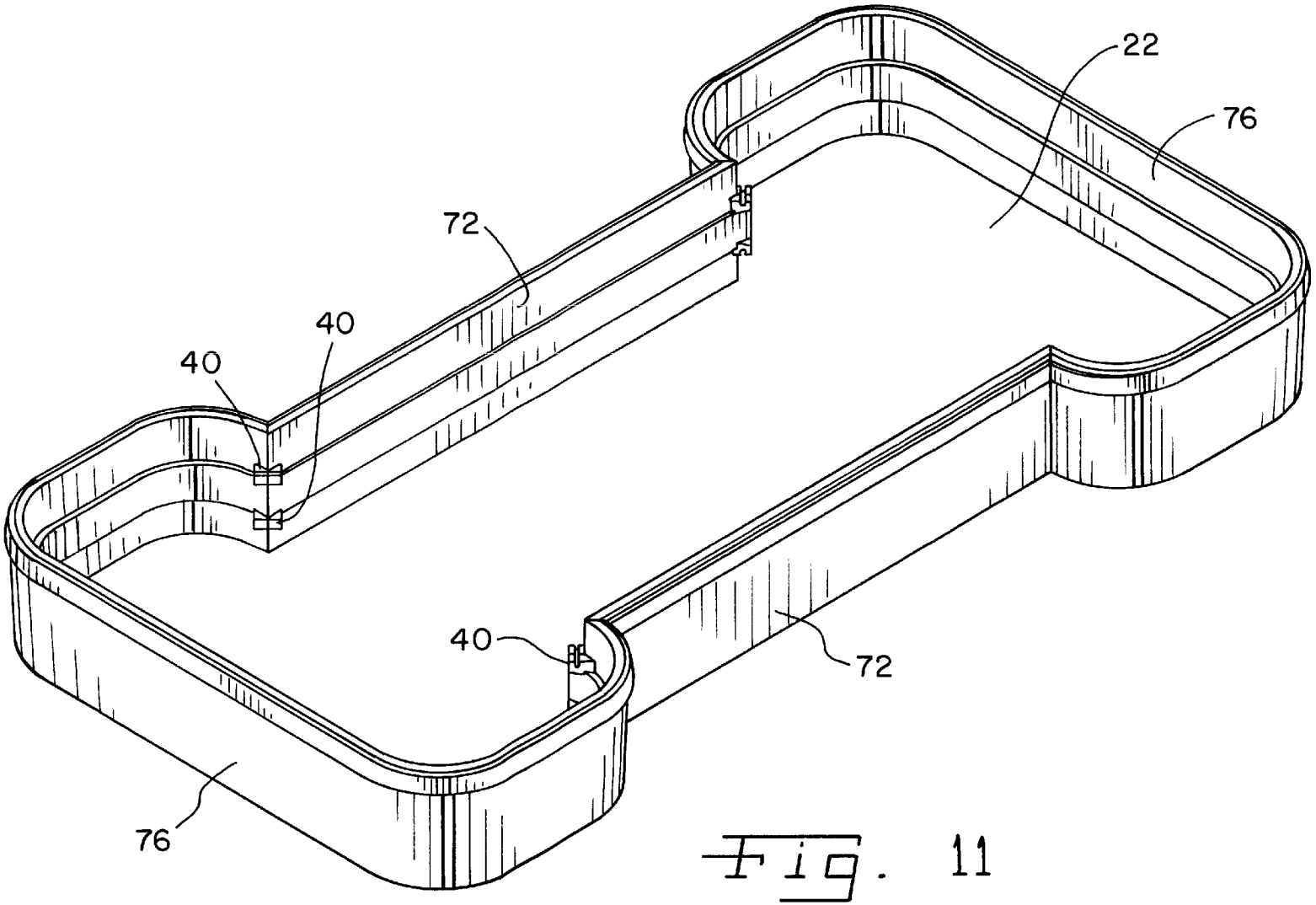
FIG. 11 is a perspective view of the present invention depicting two curved and two linear segments of non-metallic form adjoined together.

FIG. 11 shows the embodiment of assembly 12 with linear segments 72 and "C" shaped curved segments 76. Linear segment 72, "C" shaped curved segment 76 are fastened together by a plurality of bolts 40.

Non-metallic form 14 is composed of polyethylene. The process for producing non-metallic form 14 may be one of either extrusion molded polyethylene, injection molded polyethylene, or rotationally molded polyethylene. In addition, non-metallic form 14 may be composed of numerous segments produced by different molding techniques, which are joined together. Non-metallic form 14 may be composed of any suitable non-metallic material, but most preferably plastics.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A fuel dispenser assembly comprising:

a fuel dispenser;

a non-metallic rotationally molded form, said form surrounds an inner cavity, said form including a dovetail section which acts to form an anchor, said non-metallic form capable of supporting poured concrete; and a poured concrete base, said base formed within said cavity, said fuel dispenser located above said form and connected to said base.

2. The assembly of claim 1 wherein said non-metallic form contains a channel.

3. The assembly of claim 2 further comprising:

an exterior cover with tab, said tab adapted to mate with said non-metallic form channel whereby said exterior cover is removably affixed to said non-metallic form.

4. The assembly of claim 2 further comprising:

a non-metallic band adapted to fit into said non-metallic form channel.

5. The assembly of claim 1 further comprising:

an exterior cover removably fitting over a portion of said non-metallic form.

6. The assembly of claim 1 wherein said non-metallic form is produced of rotationally molded polyethylene.

* * * * *